US012110089B2

(12) United States Patent
Collie

(10) Patent No.: US 12,110,089 B2
(45) Date of Patent: Oct. 8, 2024

(54) SAIL STRUCTURE

(71) Applicant: Team New Zealand Limited, Auckland (NZ)

(72) Inventor: Stephen James Collie, Auckland (NZ)

(73) Assignee: TEAM NEW ZEALAND LIMITED, Auckland (NZ)

( * ) Notice: Subject to any disclaimer, the term of this patent is extended or adjusted under 35 U.S.C. 154(b) by 0 days.

(21) Appl. No.: 18/211,036

(22) Filed: Jun. 16, 2023

(65) Prior Publication Data

US 2023/0356820 A1 Nov. 9, 2023

Related U.S. Application Data

(63) Continuation of application No. PCT/IB2021/061985, filed on Dec. 17, 2021.

(60) Provisional application No. 63/127,127, filed on Dec. 17, 2020.

(51) Int. Cl.
*B63H 9/068* (2020.01)
*B63H 9/067* (2020.01)

(52) U.S. Cl.
CPC ..... *B63H 9/068* (2020.02); *B63H 9/0678* (2020.02)

(58) Field of Classification Search
CPC ..... B63H 9/068; B63H 9/0678; B63H 9/065; B63H 9/067; B63H 9/04; B63H 9/06; B63H 9/061; B63H 9/0615; B63H 9/0621; B63H 9/0628; B63H 9/0635; B63H 9/0671; B63H 9/0673
See application file for complete search history.

(56) References Cited

U.S. PATENT DOCUMENTS

| | | | | |
|---|---|---|---|---|
| 4,476,799 | A * | 10/1984 | Bandy | B63H 9/067 114/102.33 |
| 4,672,907 | A | 6/1987 | Smale | |
| 4,854,255 | A | 8/1989 | Kief | |
| 5,315,948 | A | 5/1994 | Brown | |
| 6,843,194 | B1 | 1/2005 | Baudet | |
| 8,506,739 | B2 | 8/2013 | Gautier et al. | |

FOREIGN PATENT DOCUMENTS

| | | | |
|---|---|---|---|
| DE | 3320321 | A1 | 12/1984 |
| EP | 0375111 | A1 | 6/1990 |
| ES | 1073250 | U | 11/2010 |
| FR | 2585324 | A1 | 1/1987 |
| GB | 2194499 | A | 3/1998 |

OTHER PUBLICATIONS

Peng, Grasyon, Synder. "What makes a material bendable? A thickness-dependent metric for bendability, malleability, ductilty" Matter. Sep. 1, 2021 pp. 2694-2696 (Year: 2021).*

* cited by examiner

*Primary Examiner* — Andrew Polay
(74) *Attorney, Agent, or Firm* — BRYAN CAVE LEIGHTON PAISNER LLP

(57) ABSTRACT

Disclosed is a sail comprising a head, a tack, and a luff extending between the head and the tack; a luff region extending along the luff; wherein the luff region has a significantly higher degree of elasticity compared to the average elasticity of a remainder of the sail. Also disclosed is a method of making a sail comprising laying out material to form the sail; arranging material in a luff region of the sail and in the remainder of the sail such that in the direction of the luff, the luff region has a higher degree of elasticity compared to the remainder of the sail; curing or sewing the sail to form a cohesive structure.

23 Claims, 10 Drawing Sheets

SAIL STRUCTURE

CROSS REFERENCE TO RELATED APPLICATIONS

This application is by-pass continuation filing under 35 U.S.C. 111 of International Application No. PCT/IB2021/061985, filed on Dec. 17, 2021, which claims the benefit of and priority to U.S. Provisional Application No. 63/127,127, filed on Dec. 17, 2020, the contents of which are all hereby incorporated by reference herein in their entirety.

FIELD OF THE INVENTION

The present invention is directed to a sail structure for a yacht which provides a modification of conventional sail design in order to retain the conventional mast and rigging design, while increasing the ability to modify the shape of the sail to react to different conditions. More particularly, the present invention provides a sail having a region of lower elastic modulus and higher failure strain at the luff region.

BACKGROUND

On sailing yachts it is desirable to make adjustments that change sail shapes to suit different conditions or points of sail (heading relative to the wind). A significant part of this is adjusting the depth or camber of a sail. A deeper sail can provide more thrust but also more drag and side force. In situations where there is more wind pressure available than is required to provide sufficient force it is desirable to flatten the sails to reduce aerodynamic drag.

It is desired to address or ameliorate one or more disadvantages or limitations associated with the prior art, provide a sail, or to at least provide the public with a useful alternative.

SUMMARY OF THE INVENTION

In a first aspect there is described a sail that comprises a region of elastic material in the luff region of the sail.

In a further aspect there is described a sail wherein the composite sail material in the luff region of the sail has a lower stiffness and higher failure strain in the direction parallel to the luff relative to material further aft in the sail.

In a further aspect there is described a sail comprising a head, a tack, and a luff extending between the head and the tack; a luff region extending along the luff; wherein the luff region has a higher degree of elasticity compared to a remainder of the sail.

A sail comprising: a head and a tack; a luff edge extending between the head and the tack; a luff region comprising the luff edge and at least a portion of the sail adjacent the luff edge; wherein the degree of elasticity of the luff region and the degree of elasticity of a region of the sail adjacent the luff region are configured such that, when the sail is mounted to a sailing boat, tensioning the luff region assists to flatten the sail to a greater extent than would be achievable if the luff was of equivalent stiffness to a remainder of the sail.

In a further aspect there is described a sail wherein the material in the luff region of the sail has a higher failure strain in the direction parallel to the luff relative to material further aft in the sail.

In a further aspect there is described a sail that comprises a region of elastic material in the luff region of the sail, such that tensioning of the luff directs load into the body of the sail and pulls the maximum draft of the sail to windward.

In a further aspect there is described a sail that comprises a region of elastic material in the luff region of the sail, the sail being adapted such that when in use tensioning the luff region assists to flatten the sail to a greater degree than a conventional sail with a stiff luff.

In a further aspect there is described a sail that comprises at least two different materials (preferably, composite materials) wherein the material in the luff region of the sail has a higher average elasticity in the direction of the luff than that of the remainder of the sail.

In a further aspect there is described a sail that comprises a material in the luff region of the sail, where the elastic properties of material in a direction within 15° of being parallel to the luff have:

(i) a failure strain of at least 2.5%, or (ii) an average Youngs Modulus of less than 50 GPa, or (iii) both (i) and (ii).

In a further aspect there is described a sail that comprises a material in the luff region of the sail, where the elastic properties of the load bearing material in a direction within 15° of being parallel to the luff have:

(i) a failure strain of at least 2.5%, or (ii) an average Youngs Modulus of less than 50 GPa, or (iii) both (i) and (ii), the elastic material extending along at least 50% of the distance between the head and tack of the sail, and at least a portion of the elastic material extending on average up to 50% of the width of the sail towards the leech of the sail.

In a further aspect there is described a sail that comprises at least two different materials (or composite materials) being a first material (or composite sail material) in the luff region of the sail and a second material (or composite sail material) that defines the remainder of the sail, wherein the average stiffness of the first material (i.e. elastic material) is less than about 5, 10, 15, 20, 25, 30, 35, 40, 45, to about 50% of the average stiffness of the second material, the first material extending along at least 50% of the distance between the head and tack of the sail, and at least a portion of the first material extending up to 50% of the width of the sail towards the leech of the sail.

In a further aspect there is described a sail that comprises at least two different materials (or composite sail materials) being a first material (or composite sail material) in the luff region of the sail and a second material (or composite material) that defines the remainder of the sail, wherein the Youngs modulus of the first material (i.e. elastic material) is less than about 5, 10, 15, 20, 25, 30, 35, 40, 45, to about 50% of the average Youngs modulus of the second material, the first material extending along at least 50% of the distance between the head and tack of the sail, and at least a portion of the first material extending up to 50% of the width of the sail towards the leech of the sail.

In a further aspect there is a method of manufacturing a sail as described above.

In a further aspect the composite sail materials described above are constructed as sections of woven or knitted fabrics that are glued or stitched together.

In a further aspect the composite sail materials described above are constructed as using load bearing yarns, fibers or filaments laminated between sheets of fabric or plastic or both.

In a further aspect the composite sail materials described above are constructed by curing layers of reimpregnated tapes that comprise of a mixture of fibrous reinforcement and polymeric matrix.

In a further aspect there is described a method of using a sail that comprises a luff region with a higher degree of elasticity compared to the average elasticity of the remainder of the sail.

The following embodiments may relate to any of the above aspects.

In one configuration the second material may have an increased amount of material along the fringe of the two materials in order to attract more load to this region of the sail and to reduce stretch in this region of the sail.

In one configuration the sail is a mainsail.

In one configuration the sail is a headsail.

In one configuration the elastic material (or first material) has a failure strain in the direction parallel to the luff of at least 2.5, 3.0, 3.5, 4.0, 4.5, 5.0, 5.5, 6.0, 6.5, 7.0, 7.5, 8.0, 8.5, 9, 9.5 or 10%, and suitable ranges may be selected from between any of these values.

In one configuration the elastic material (or first material) has an average stiffness in the direction parallel to the luff that is about 4% to about 50% of the average stiffness of the material in the remainder of the sail, and suitable ranges may be selected from between any of these values.

In one configuration there is an absence of sail fibres, or sailcloth fibres that extend in a direction parallel, or at least substantially parallel, to the luff in the luff region.

In one configuration the sail fibres, or sailcloth fibres, in the luff region of the sail extend in a line that is an angle of greater than about 15, 20, 25, 30 or 35° relative to a direction that is parallel to the luff of the sail, and suitable ranges may be selected from between any of these values.

In one configuration the elastic material (or first material) extends at least 50, 55, 60, 65, 70, 75, 80, 85, 90 or 95% of the distance between the head and tack of the sail, and suitable ranges may be selected from between any of these values.

In one configuration a portion of the elastic material (or first material) extends up to about 10, 20, 30, 40, or 50% of the width of the sail towards the leech of the sail, and suitable ranges may be selected from between any of these values. Typically, the further aft the elastic portion extends the larger the effect on the ability to flatten the sail, but this can come with an adverse effect on the fairness of the section shapes.

In one configuration, the elastic material (or first material) extends towards the leech of the sail to a greater extent in the middle of the sail (relative to the height of the sail) compared to the luff regions towards the head and tack of the sail.

In one configuration the sail includes a band of material ("the third material") between the first material and the second material having stiffness which is higher than both the first material and the material in the remainder of the sail.

In one configuration the third material extends from the head to the tack of the sail.

In one configuration the elastic material (or first material) comprises a gradient of elasticity over the width (chordwise) of the elastic material, as defined by its (i) failure strain, and (ii) average stiffness over the chordwise width of the elastic material within the luff region.

In one configuration the elastic material (or first material) comprises polyester.

In one configuration the elastic material (or first material) comprises polyester in combination with one or more of aramid and/or ultra-high molecular weight-polyethylene (UHMWPE).

In one configuration the second material comprises carbon.

In one configuration the elasticity of the elastic material (or first material) decreases from the elastic material adjacent the luff to the elastic material aft of the luff.

In a further aspect there is disclosed a sail comprising a head, a tack, and a luff extending between the head and the tack;

a luff region extending along the luff;

wherein the luff region is less stiff compared to a remainder of the sail and consequently has a higher degree of elasticity compared to the remainder of the sail.

In a further aspect there is disclosed a method of making a sail comprising the steps of:

laying out material to form the sail;

arranging material in a luff region of the sail and in the remainder of the sail such that in the direction of the luff, the luff region has a higher degree of elasticity compared to the remainder of the sail;

curing or sewing the sail to form a cohesive structure.

A method of making a sail having a luff region, wherein in the direction along a luff of the sail, the luff region has a higher degree of elasticity than the remainder of the sail.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.)

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The term "elastic" as used in this specification in relation to regions of a sail, or materials used therein, means "being more deformable than a material not indicated as being elastic". Herein, the term "deformable" can refer to the elastic region or material undergoing more deformation at a given load than a region or material which is not indicated as being elastic and can also refer to the elastic region or material being able to undergo comparatively high amounts of reversible (as compared to irreversible or "plastic") deformation without failure.

As the skilled person will appreciate, in some fields of technology, when a first region or material undergoes a higher amount of deformation at a given load than another region or material, that first region or material would be described as having a lower stiffness or being less stiff than the other region or material. It is to be understood that the term "elastic" as used in this specification encompasses this meaning.

Similarly, the skilled person will appreciate that the property of a material of tolerating high amounts of reversible deformation is sometimes referred to as the material being "ideal elastic" and/or as the material having a high yield strain or failure strain. It is to be understood that the term "elastic" as used in this specification encompasses this meaning as well.

BRIEF DESCRIPTION OF THE FIGURES

The invention will now be described by way of example only and with reference to the drawings in which.

DETAILED DESCRIPTION OF THE INVENTION

Described is a sail having material with a lower elastic modulus and higher failure strain in the luff region compared to the body of the sail. This provides for a sail that is effective to power up or power down the sail in response to the wind speed or the heading of the yacht relative to the wind direction.

Sail power is controlled by three main power sources being angle of attack, camber (or depth) and twist.

Camber is the amount of curvature (otherwise known as depth) in a sail. It is measured as a proportion of the distance from luff to leech. A mainsail with a maximum camber of 5% is a flat sail, while a camber of 15% would mean a deep or full main.

A deep (or fuller) sail provides more force while a flatter sail creates less drag for a given amount of total force. A flatter shape is better in heavy air when a boat is overpowered. A deep sail is better in lighter air when a boat is underpowered.

A sail can be controlled by the amount of depth as well as its position. The usual goal is to put the deepest draft position about 40-50% of the way aft from luff to leech in a mainsail and 30-40% aft for the jib.

Draft position (along with camber) is adjusted using the halyard and/or cunningham. Ideally the draft is set and is kept at about 30% to about 50% away from the luff. However, as the wind strength increases, wind pressure will move the draft position aft and the halyard and/or cunningham will require tensioning to move the draft forward once again.

Old sails, which have been permanently deformed, show their age because more and more halyard and/or cunningham tension is required to keep the sails flat and to maintain the draft correctly positioned.

In light winds it is often advantageous to move the draft aft by slackening the halyard or cunningham.

Tightening the headsail halyard, or cunningham, will typically move the draft forward and make it flatter. Easing the genoa halyard, or cunningham, will typically move it aft and make the sail fuller.

Figure 1:
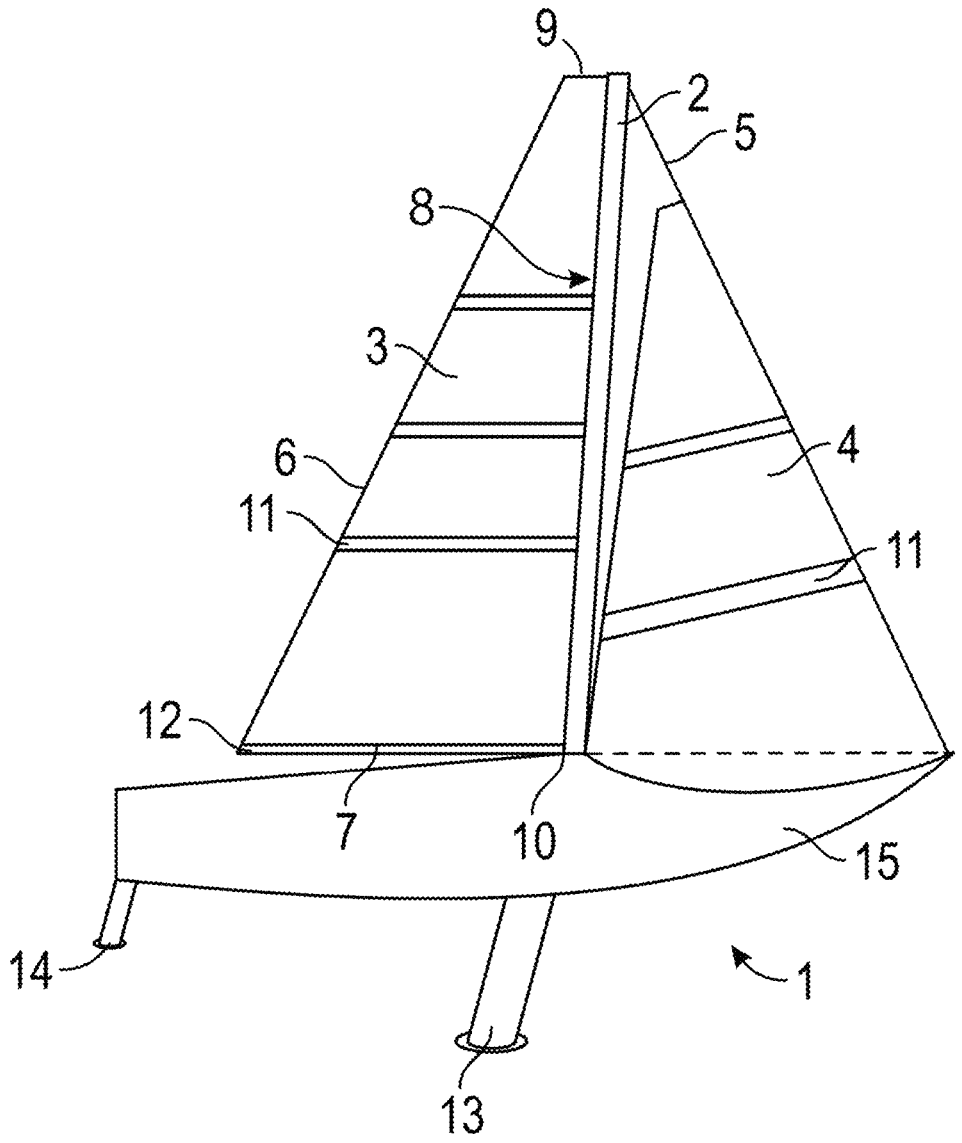
FIG. 1 is a stylised side view of a Bermuda rigged sailboat, having a main sail and headsail.

The general arrangement of the most basic elements of a yacht 1 is shown in FIG. 1, which depicts a Bermuda rigged yacht. While a Bermuda rigged yacht is shown it should be appreciated that the elastic luff can be utilised on other rig styles. A yacht 1 typically comprises a mainsail 3 and a head sail 4 (which includes genoas, jibs and staysails). The mainsail 3 body comprises a head 9, being the top, a tack 10, being the leading edge bottom corner, and a clew, being the trailing edge bottom corner. The mainsail 20 further has a luff 8, being the leading edge, a leech 6, being the trailing edge, and a foot 7, being the bottom.

The mainsail is typically attached to the mast, the mast generally including a track through which a portion of the edge of the sail luff 8, or clips that attach to the sail luff, travel to retain the sail to the mast 2. A main halyard attaches to the head 9 of the sail and is used to host the sail up the mast 2. A boom 12 extends from the mast and attaches to the foot 7 of the sail. The boom 12 typically includes a tract that through which a portion of the edge of the sail foot 7, or clips that attach to the sail foot 7, travels to retain the sail to the boom 12. On larger yachts, the boom 12 may include a self-furling system such as an in-boom furling system. Some yachts may not have a boom and instead are sheeted directly to the yacht.

The sail typically includes 1 or more battens 11 that assist sail shape and performance. The battens can be more or less evenly-spaced along the leech of the sail. These battens tension the sail, provide rigidity and help maintain a smooth aero dynamic shape. The battens 11 typically are inserted into a slot or sleeve in the sail that extends from the leech 6 of the sail 3 towards the luff 8 of the sail 3. Given sails are formed by a flexible sheet material, typically made largely of non-rigid materials and rigid materials, the battens help the sails to resist compression, which would lead to wrinkling of the sail. Battens are formed of rigid materials such as fibre reinforced plastics of fibreglass, carbon fibre, or a combination thereof. Once inserted into the sleeve in the sail 3, the battens are typically placed under longitudinal compressive load. For example, through the use of an elastic portion within the sleeve.

The headsail 4, if present, sits forward of the mainsail 3 and typically attaches to the forestay 5, using attachment devices such as by clips or pockets on the luff 7 of the headsail 4. The headsail 4 can be hoisted up the forestay 5 via a headsail halyard that extends from the mast 2. There are a range of different types of headsails 4 with the Genoa and Jib being the most commonly used. Both these types have different subtypes depending on their intended use. Headsails 4 are usually classified according to the relative weight of the sailcloth used and the size or total area of the sail. The headsail 4 may include battens 11 that assist in maintaining an optimal shape for the sail.

As described, the luff region of the headsail or mainsail can be formed from material that has a degree of elasticity.

Suitable materials may comprise, for example, yarns, filaments, fibres, fabric or film. This elastic material provides for greater stretch, for example, in a direction parallel to the luff or mast, as tension is applied in this direction. It is to be understood that the luff region includes the luff but can include regions of the sail that extend some way aft from the luff as well, as indicated in, for example, FIG. 7.

In general terms, techniques of manufacturing the sail comprise composite tapes where the load bearing fibers are impregnated with resin (no external films, 3Di), laminated string sails where the load bearing fibers (yarns) are sandwiched between plastic films, and panel sails where rectangular or triangular panels of fabric are stitched or glues together. It is to be understood that any of the above techniques may be used to manufacture both the luff region of the sail and the remainder of the sail, and that the orientation of the load bearing fibers or yarns may be varied in the luff region and the remainder of the sail to achieve a higher degree of elasticity in the luff region. As explained above, the term "higher degree of elasticity" includes the meaning of "lower stiffness" and/or the meaning of "higher failure strain", and/or generally "higher deformability".

In one embodiment, the sails of a yacht (i.e., mainsail and the headsail) comprise an elastic material in the luff region and a stiff material running from the tack to head through the body of the sail. Due to this arrangement of the materials, in the present invention, when pulled down on the tack with the head fixed (or vice versa), the primary structural band (the second, or stiffer, material) of the sail straightens and thus flattens the sail.

In this embodiment, the elastic material may extend along at least 50% of the distance between the head and tack of the sail, and at least a portion of the elastic material extending on average up to 50% of the width of the sail towards the leech of the sail. By allowing the luff region to stretch the tack can be pulled down further which straightens the primary structural band through the body of the sail. This flattens the sail to a much greater degree than would be achievable if the luff region was stiff.

In one embodiment the elastic region comprises a fibrous material with a linear density of about 200, 600, 1000, 1400, 1800, 2200, 2600, 3000, 3400, 3800 or 4200 dtex, and suitable ranges may be selected from between any of these values. In one embodiment the fiber material that forms the elastic region has an elongation at break of about 10, 11, 12, 13, 14, 15, 16, 17, 18, 19 or 20%, and up to 30%, and suitable ranges may be selected from between any of these values. In one embodiment the material that forms the elastic region comprises, or is formed from, polyester.

In some embodiments the elastic region comprises a fibrous material with a linear density of about 200, 600, 800, 1000, 1400, 1800, 2200, 2600, 3000, 3400, 3800 or 4200 dtex, and suitable ranges may be selected from between any of these values. In some embodiments the elastic region comprises a material with an elongation at break of about 2, 2.5, 3, 3.5 or 4%, and suitable ranges may be selected from between any of these values. In some embodiments the elastic region comprises of aramid fibres.

While polyester and aramid have been given as examples for materials suitable for use in the elastic (or first) region, other materials may be used as well, including such with elongation at break between the values given in the above for polyester and aramid. Materials may also be used that have larger values of elongation at break than those indicated for polyester, for example, nylon.

In one embodiment the elastic region comprises a material with a linear density of about 200, 6000, 1000, 1400, 1800, 2200, 2600, 3000, 3400, 3800, 4200 dtex, and suitable ranges may be selected from between any of these values. In one embodiment the material is a ultra-high molecular weight polyethylene.

In some embodiments, the luff region or elastic region does not include fibres oriented in a direction parallel to the luff. Instead, the sail in the luff region may be constructed from a material like carbon tapes or yarns that are oriented so that they do not have any fibers supporting load in the luff direction. In these embodiments, when the remainder of the sail does include fibers oriented in the direction parallel to the luff, a relative decrease in stiffness of the luff region parallel to the luff is achieved which leads to the favourable effects in relation to flattening the sail set out in this disclosure.

The elastic region may be formed from a combination of materials to form a composite, laminate, or fabric. The three types of materials defined above may be combined in ratios to provide the desired degree of elasticity, in combination with or without resin (matrix) material or a plastic film in the case of laminate sails.

The stiffer material may be selected from carbon, or may be formed from a combination of materials to form a composite, laminate or fabric. Examples of suitable materials include combinations of carbon and ultra-high molecular weight polyethylene (UHMWPE), aramid, and aramid/polyester. The stiffer material may have an elongation at break of about 0.5%, 1.0%, 1.5% or 2.0% and suitable ranges may be selected from between any of these values. The carbon may have a modulus of about 200, 250, 300, 350, 400, 450 to 500 Gpa, and suitable ranges may be selected from between any of these values.

The carbon may also be used in the material in the elastic region to give an element of stiffness but with the fibre orientation at a greater angle to the luff. A preferable range for this angle comprises angles greater or equal than 20 degrees.

The materials used in the luff region include, but may not be limited to 100% polyester (closest to the luff), polyester/aramid mixture and carbon or a carbon/UHMWPE mixture. The stiffness and strength of the elastic elements used in the luff region are be summarised below:

Polyester
Youngs Modulus=1-20 GPa
Failure strain 6-10%
Aramid
Youngs Modulus=80-120 GPa
Failure strain 2-3%
UHMWPE
Youngs Modulus=80-120 GPa
Failure strain 3.0-4.0%
Carbon
Youngs Modulus=200-500 GPa
Failure strain 0.5-2.0%

Figure 2:
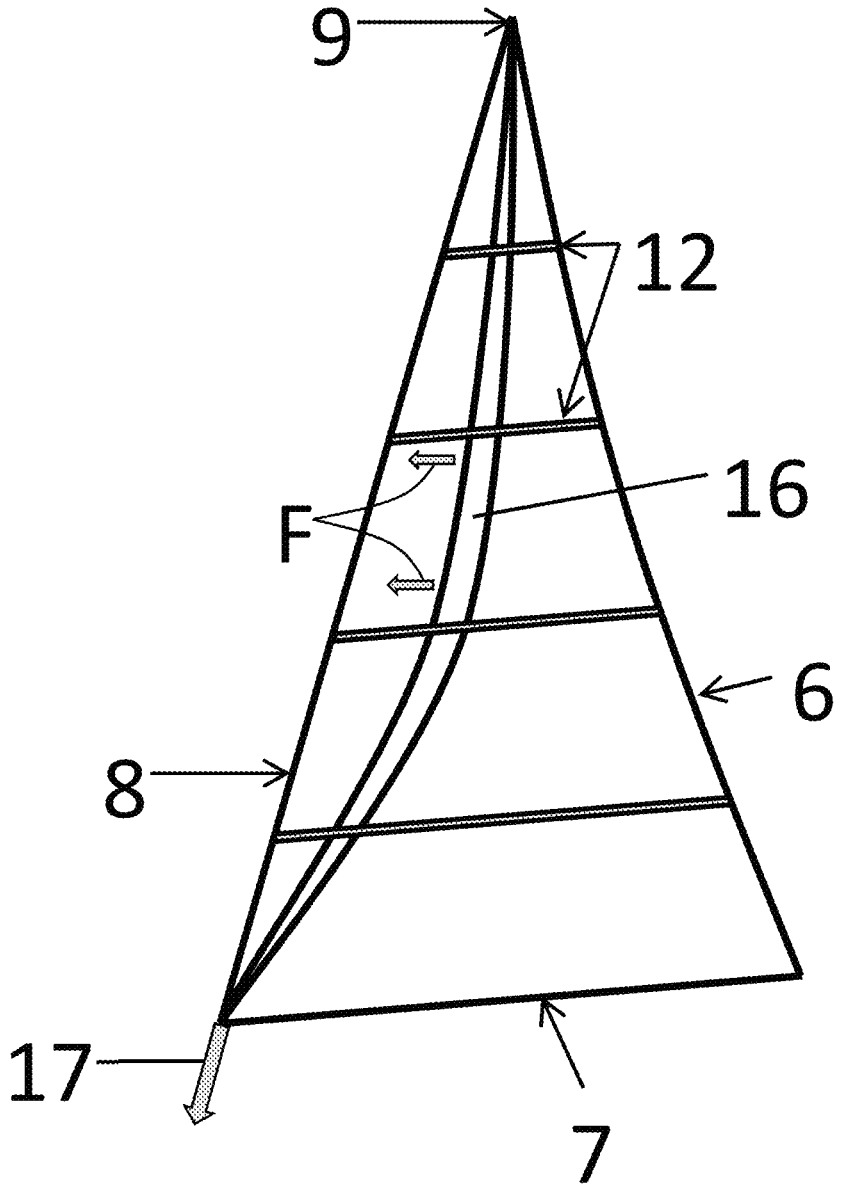
FIG. 2 is a side view of sail.
Figure 3:
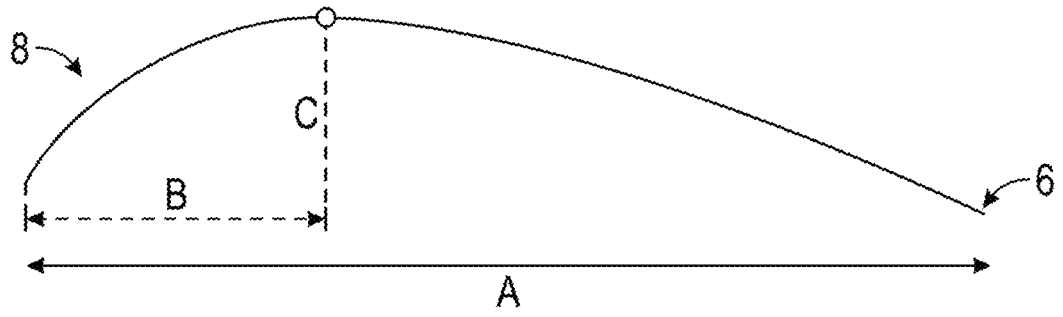
FIG. 3 is a cross section through a sail.
Figure 4:
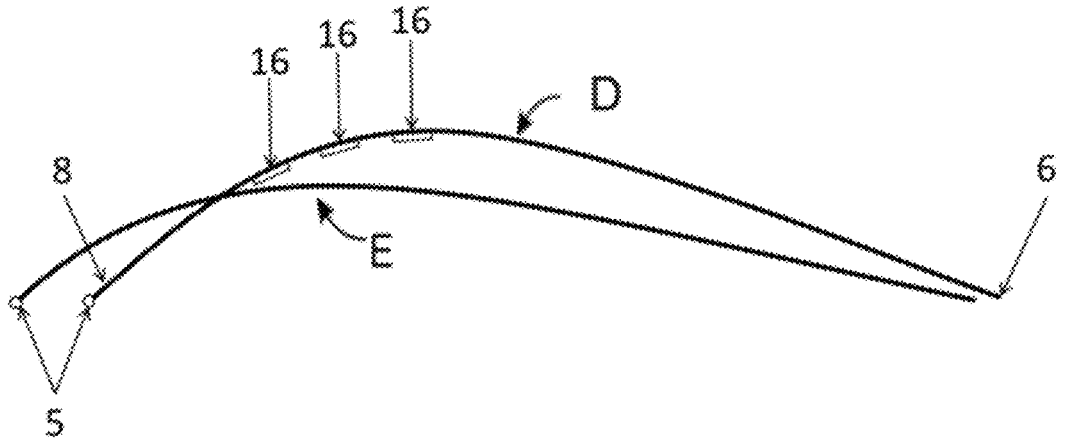
FIG. 4 is a cross section through a sail showing a sail (D) with tension released on the luff of the sail to produce a sail with increased camber and a sail (E) with tension applied to the luff of the sail to produce a sail with the camber moved towards the bow and having a flatter profile.
Figure 5:
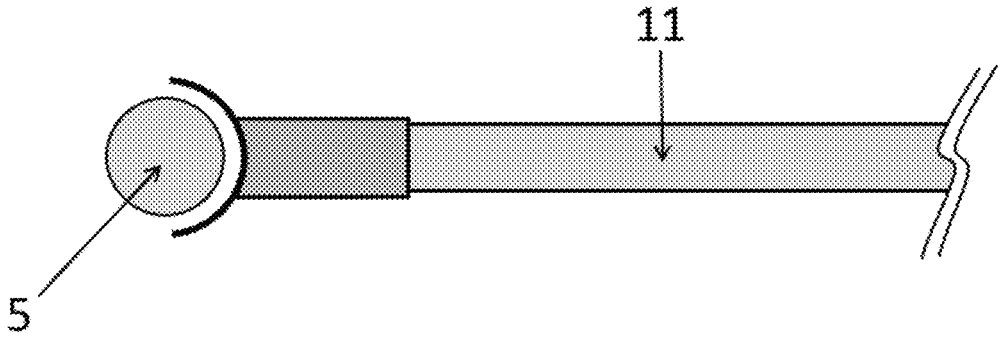
FIG. 5 is a top stylised view of a batten as it may attach to, or bear upon a forestay.

According to an embodiment of the invention, as depicted in FIG. 2, when the tack 10 is pulled down through a luff tensioner 17 in the downward direction, then the load predominantly travels from tack through the front of the stiff region of the sail. If the sail had constant stiffness then the load would predominantly travel though the most direct path which is directly up the luff of the sail. As tension is increased in the luff region, the area of greater stiffness 16 moves in the direction of the force F and straightens which results in a reduction of sail camber. The force F may produce compressive forces in the sail that are typically carried through to the forestay through the battens. This force can project the luff (and forestay) forward. In some embodiments, the sail could be designed without any battens but with bending stiffness so as to take compression in the direction of the force F, but this region would also need to have high elasticity in the direction parallel to the luff.

As mentioned, the sails may include battens that can bear and push the forestay forward and this effect is enhanced with the use of the elastic material on the luff.

As a mainsail is pulled down on the tack, the battens could push against the mast and may help it bend. Also, the aft angles of the primary load paths out of the tack and head of the sail, which is generated due to the shape of the front of the second (stiffer) region, induces increased bending of the mast.

In the present invention, the mainsail and/or the headsail comprises of stiff and elastic regions in which the elastic regions have high failure strain and low Young's modulus compared to the stiffer materials which have low failure strain and high Youngs modulus.

Furthermore, at the margin between the elastic region and the rest of the sail, there is a zone of material with higher stiffness.

The camber and draft position can be adjusted with forestay tension. This is easy to adjust on a masthead rigged boat if there is an adjustable backstay.

Figure 6:
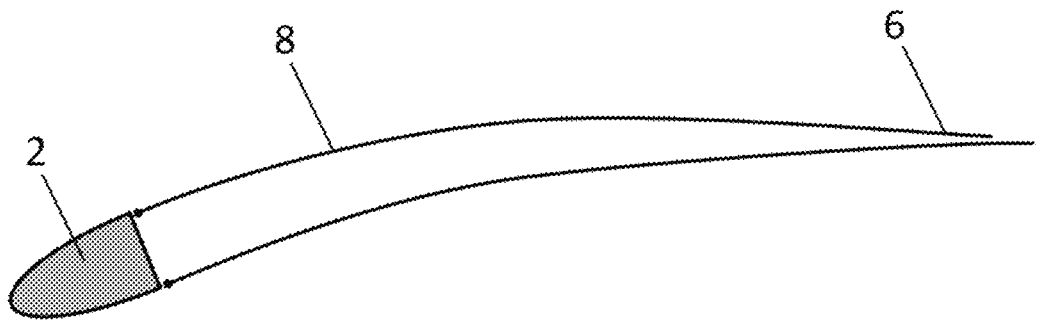
FIG. 6 is a top view of a twin skin mainsail.

Referring to FIG. 6 embodiment, there is shown a mast 2 with respect to the leech 6 and luff 8 of the sailboat 1. In this embodiment two mainsails are attached with one each side of the aft face of the mast in order to make a smooth aerodynamic section. A skilled addressee will appreciate that even for these configurations with more than one sail, elastic material with high failure strain in the luff region in combination with relatively stiffer material aft in the sail can be used to enable more effective shape control and depowering through application of luff tension via the cunningham or halyard. The embodiments of the invention described previously for conventional mainsails apply equally to this twin mainsail configuration. In one embodiment, what is disclosed is a sail comprising a load bearing material in the luff region of the sail, wherein under highest stress, the elastic properties of the load bearing material in a direction within 15 deg of being parallel to the luff may have: (i) a failure strain of at least 2.5%, or (ii) an average Youngs Modulus of less than 60 GPa, or (iii) both (i) and (ii), the elastic material extending along at least 50% of the distance between the head and tack of the sail, and at least a portion of the elastic material extending on average up to 50% of the width of the sail towards the leech of the sail. The sail could be a mainsail or a headsail.

The sail may comprise two different materials being a first material in the luff region of the sail and a second material that defines the remainder of the sail, wherein the average elasticity of the first material (i.e. elastic material) is at least about 2, 4, 8, 10, 12, 14, 16, 18, 20, 22, 24, 26 times higher than the average elasticity of the second material, and suitable ranges may be selected from between any of these values. The materials are preferably composite materials, or a mixture of two or more different types of materials.

The elastic or first material may have a failure strain of at least about 2.5, 3, 3.5, 4, 4.5, 5, 5.5, 6, 6.5, 7, 7.5, 8, 8.5, 9, 9.5% to about 10%, and suitable ranges may be selected from between any of these values. The elastic material (or first material) may have an average Youngs Modulus of about 1 to about 60 GPa.

It will be appreciated that the material of the sail is a composite of multiple materials. Some of those materials will have a Youngs Modulus of less than 50 GPa (e.g. glue, mylar, plastics etc).

However, when referring to a failure strain, what is being referred to is the main load bearing material in a region of the sail, such as the luff region. While incidental material may include a failure strain less than 2.5%, given that material does not form a significant portion of the sail material, it is not to be considered when assessing failure strain.

The direction of the elasticity being considered may be limited to being along or within about 15° relative to the luff.

There may be an absence of sail fibres, or sailcloth fibres that extend in a direction parallel, or at least substantially parallel, to the luff in the luff region of the sail. The sailcloth fibres in the luff region of the sail extend in a line that is an angle of greater than about 15, 20, 25, 30, 35, 40 to about 45° relative to a direction that is parallel to the luff of the sail, and suitable ranges may be selected from between any of these values. As the skilled person will appreciate, such orientation of the fibres in the luff region leads to a limitation of the load that the material in the luff region can take in the luff direction. In other words, such wider angles contribute to the luff region having a lower stiffness in the luff direction.

The elastic material (or first material) may extend at least 50, 55, 60, 65, 70, 75, 80, 85, 90 to about 95% of the distance between the head and tack of the sail, and suitable ranges may be selected from between any of these values. The elastic material (or first material) extends up to about 20, 30, 40 to about 50% of the width of the sail towards the leech of the sail, and suitable ranges may be selected from between any of these values.

The elastic material (or first material) may extend towards the leech of the sail to a greater extent in the middle of the sail (relative to the height of the sail) compared to the luff regions towards the head and tack of the sail.

The elastic material (or first material) may comprise polyester, or polyester in combination with one or more of aramid and UHMWPE. The second and third materials may comprise carbon, aramid or a combination of carbon, aramid and UHMWPE. The composition or % of aramid and UHMWPE in the central region of the luff region of the sail may be lower than in the upper and lower regions of the sail.

The elastic material (or first material) may comprise a gradient of elasticity, as defined by its: (i) failure strain, or (ii) average Youngs Modulus, or both (i) and (ii), over the width of the elastic material within the luff region. The elasticity of the elastic material (or first material) may decrease from the elastic material adjacent the luff to the elastic material aft of the luff. This gradient of elasticity can be achieved either by varying stiffness or through the use of different materials, or concentrations of different materials.

Figure 7:
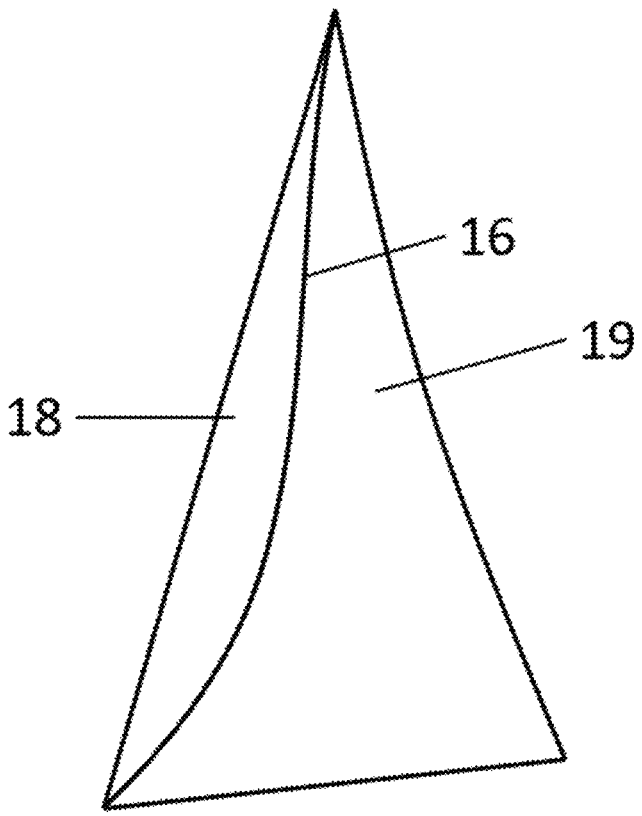
FIGS. 7-9 depict a side view of the sail in different configurations when in use.
Figure 8:
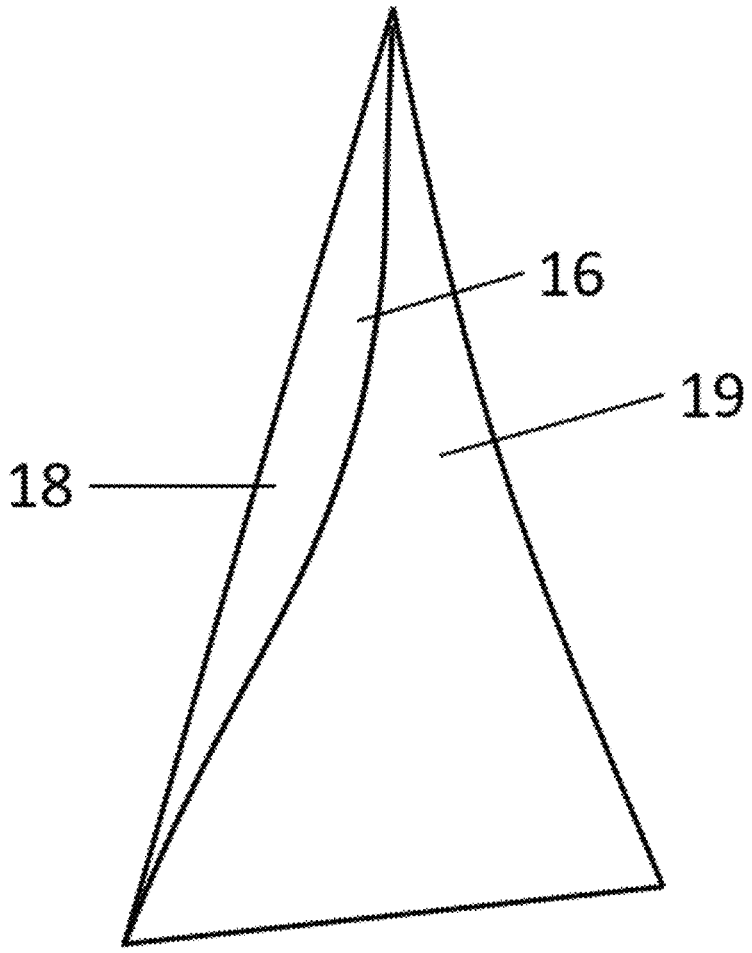
Figure 9:
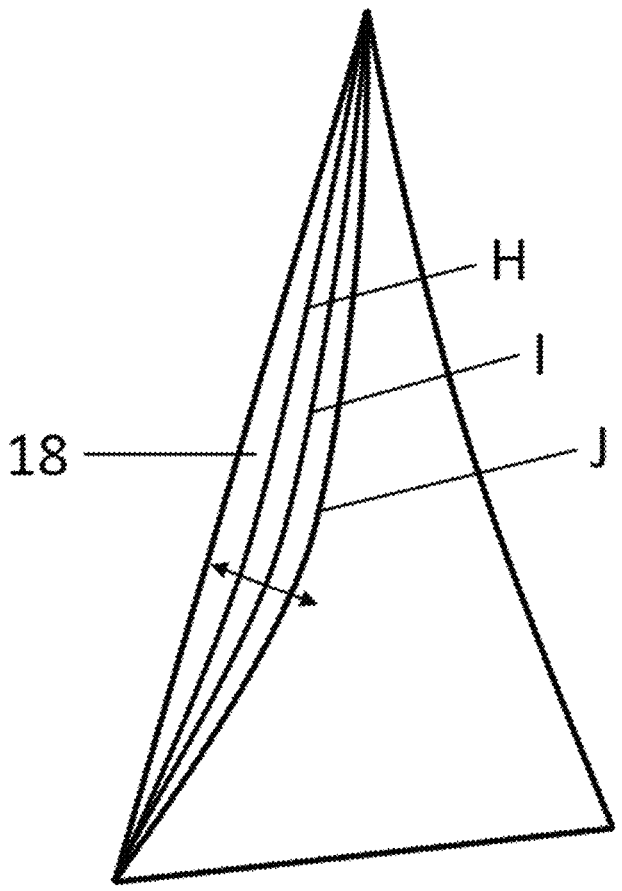
Figure 10A:
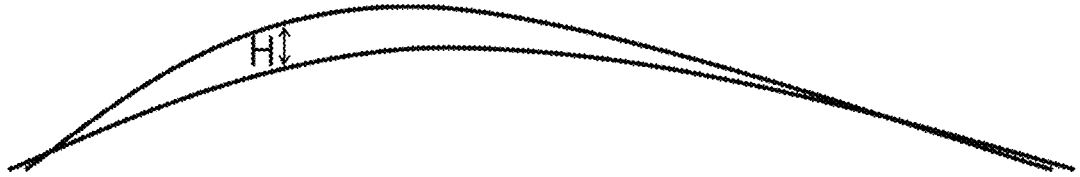
FIGS. 10A-10C are cross sectional views through a sail when in use.
Figure 10B:
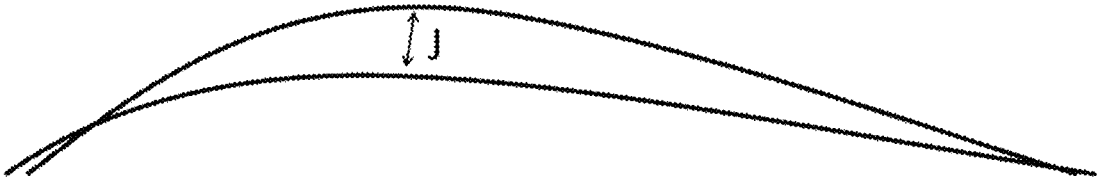
Figure 10C:
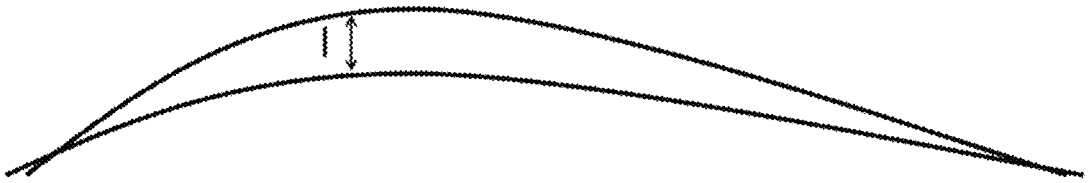

The structure and position of the stiffer material can be used to move the draft position forward or aft depending on where the structure lies relative to the natural draft position of the sail As shown in FIG. 7, the shape and positioning of the elastic region 18 relative to the stiffer sail material 19 can be modified to effect different parts of the sail. For example, as shown in FIG. 7, a lower biased structure will have more influence on the lower part of the sail. In comparison, as shown in FIG. 8, an upper biased structure will have more influence on the upper part of the sail. This will also affect the section shapes due to the tendency of the position of the edge of the stiffer region 16 to move the position of maximum draft. As shown in FIG. 9, the positioning of the boundary or fringe between the two materials can be modified to influence the sectional shape of the sail. For example, as shown in FIG. 10A, forward positioning of the fringe pushes the position of maximum draft aft. In comparison, as shown in FIG. 10B, aft positioning of the fringe pushes the position of maximum draft forward.

Figure 12A:
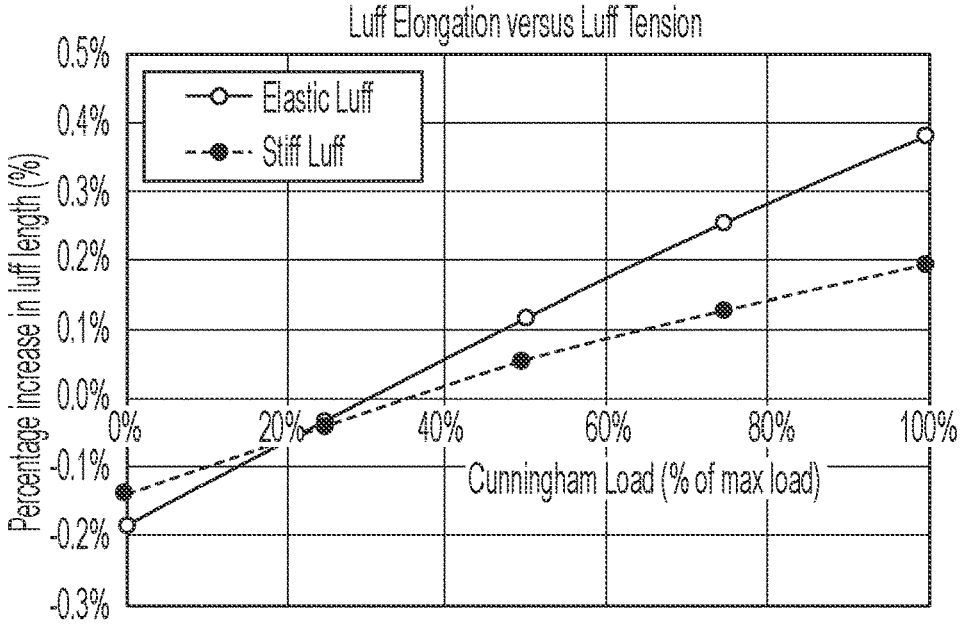
FIGS. 12A-12B show results of numerical analysis in relation to a behaviour or a performance of sails.
Figure 12B:
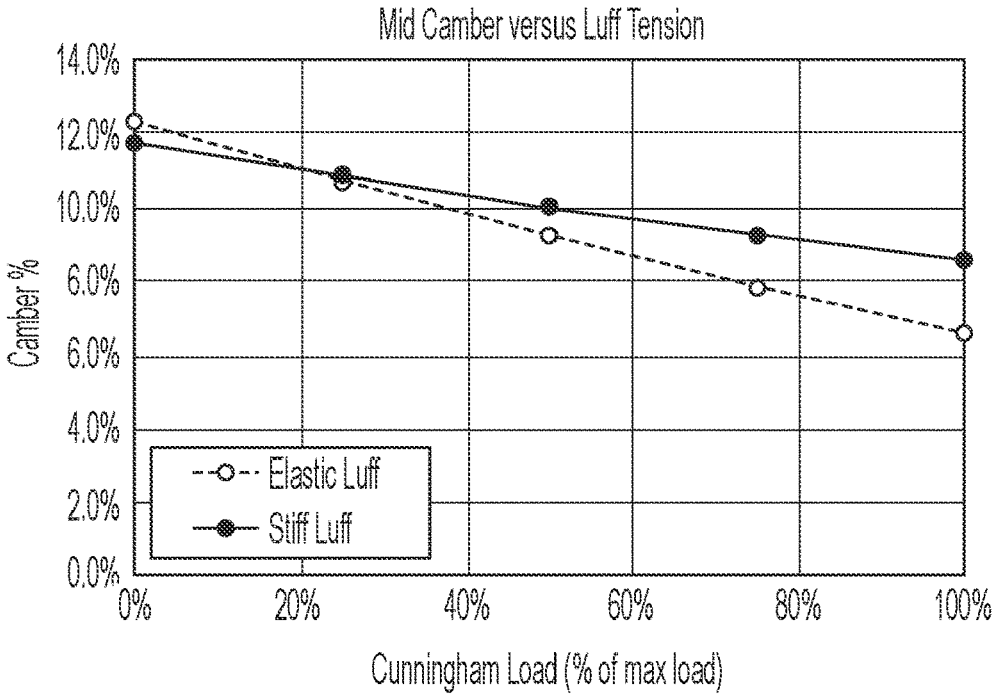

FIG. 12 shows results of a Finite-Element-Analysis (FEA) comparing a prior art sail and a sail according to the present disclosure. In FIG. 12(*a*), the solid line represents a common sail with a luff region that has approximately the same stiffness and failure strain as the remainder of the sail, while the dashed line represents a sail in accordance with the present disclosure. The skilled person will appreciate that in the prior art sail, at 100% cunningham load (horizontal axis) a percentage increase in luff length, shown on the vertical axis, is about 0.38%. Contrary thereto, the sail according to the invention exhibits an increase in luff length of about 0.19% at 100% cunningham load. In other words, as is apparent from the figure, at a given elongation of the luff the load generated in the cunningham as a percentage of maximum load is much lower in the sail according to the present disclosure, because of its lower stiffness in the luff region. As a side note in FIG. 12(*a*), a negative increase in luff length in the range of between 0% and approximately 25% cunningham load should be interpreted as wrinkles in the luff region.

The graph shown in FIG. 12(*b*) has the same horizontal axis as the one of FIG. 12(*a*) but shows sail mid camber in percent in the vertical axis. As will be apparent to the skilled person, the mid camber in the sail as disclosed herein, at 100% cunningham load, is at about 6.2% while the corresponding value in the prior art sail is at about 8.3%. In other words, the sail disclosed herein exhibits a lower mid-camber at a high cunningham load and a higher camber at a low cunningham load.

Figure 11:
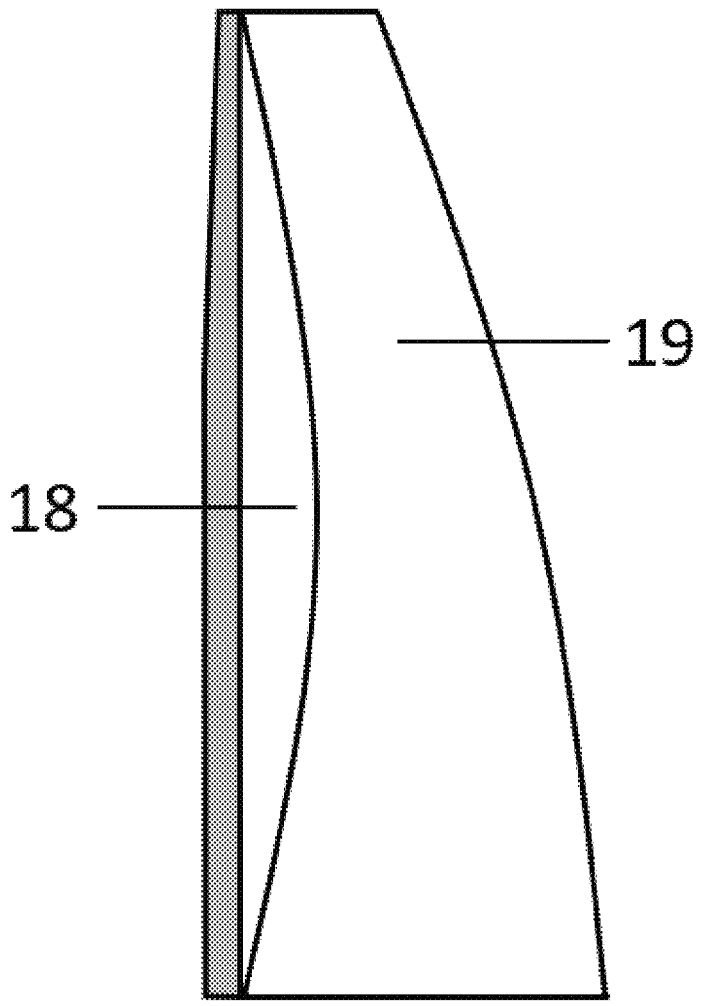
FIG. 11 is a side view of a sail with square or quadrilateral shape.

The above concepts can be applied to a range of sail shapes. For example, as shown in FIG. 11, they can be applied to a sail with more of a rectangular or quadrilateral shape comprising a mast 2, elastic region 18 and stiffer material 19. The above concepts could also be applied to twin skin sails as shown in FIG. 6. It will be understood by the skilled person that in case of a twin skin sail, the sail has two luff regions, one in each of the two skins defining the twin sail. In this embodiment, each of the two luff regions has elastic properties in relation to the respective remainder of the sail that make the luff region less stiff in the luff direction than the remainder of the sail Among other things, the above novel configurations provide an advantage in that the sail according to the present disclosure may be able to change its shape and to adjust to changes in the wind pressure or heading of the yacht relative to the wind direction.

Further, it has been found that some embodiments of the sail disclosed herein are typically lighter than a comparable prior art sail. The reason for this may be that the reduction in stiffness in the luff region may be achieved by a thinner material in this region, or by the absence of certain load bearing fibres in the direction parallel to the luff, as explained above. The saved material typically results in a lighter sail.

Moreover, in some situations, for example in yacht racing, a fixed weight of a sail is prescribed. In this case, the sail disclosed herein is advantageous over prior art sails in that the weight savings in the luff region allow for the allocation of more weight (and hence more material and stiffness) to areas of the sail where a higher stiffness is desirable to reduce stretch. These areas are typically in the body or centre of the sail where the bulk of the wind load is transferred to the head, clew and tack Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in a descriptive sense only and not for purposes of limitation, and also the technical scope of the invention is not limited to the embodiments. Furthermore, the present invention is defined not by the detailed description of the invention but by the appended claims, and all differences within the scope will be construed as being comprised in the present disclosure.

Many modifications will be apparent to those skilled in the art without departing from the scope of the present invention as herein described with reference to the accompanying drawings.

The invention claimed is:

1. A sail comprising
a head,
a tack,
a luff extending between the head and the tack; and a luff region extending along the luff;
wherein the luff region has a higher degree of elasticity compared to a remainder of the sail,
wherein the luff region of the sail includes a first material and a remainder of the sail includes at least a second material,
wherein the first material and the second material are different, and
wherein an average stiffness of the second material is in a range of 2-20 times higher than an average stiffness of the first material.

2. The sail of claim 1, wherein the sail is a mainsail.

3. The sail of claim 1, wherein the sail is a headsail.

4. The sail of claim 1, wherein the first material has a failure strain of at least about 2.5% to about 30%.

5. The sail of claim 1, wherein the first material has a failure strain of at least about 2 to about 10 times the failure strain of the second material.

6. The sail of claim 1, wherein the first material has an average Young's Modulus of about 1 to about 60 GPa.

7. The sail of claim 1, wherein the first material has an average elasticity that is at least about 100% to about 2400% higher than an average elasticity of the second material.

8. The sail of claim 1, wherein there is an absence of sail fibres, or sailcloth fibres, that extend in a direction parallel, or at least substantially parallel, to the luff in the luff region of the sail.

9. The sail of claim 6, wherein there are sail fibres, or sailcloth fibres, in the luff region of the sail, the sail fibres, or sailcloth fibres, extending in a line that leaves an angle of greater or equal than about 15 degrees Free from fibres relative to a direction parallel to the luff of the sail.

10. The sail of claim 1, wherein the first material extends at least 50% to about 95% of a distance between the head and tack of the sail.

11. The sail of claim 1, wherein the first material extends up to about 10% to about 50% of a width of the sail towards a leech of the sail.

12. The sail of claim 9, wherein the first material extends towards a leech of the sail to a greater extent in the middle of the sail relative to a height of the sail compared to the luff regions towards the head and tack of the sail.

13. The sail of claim 1, wherein the sail includes a third region having an elasticity less than other regions of the sail, this third region extending along at least a portion of a margin of the luff region between the luff region and the remainder of the sail.

14. The sail of claim 13, wherein the third region extends from the head to the tack of the sail.

15. The sail of claim 13, wherein the third region comprises carbon.

16. The sail of claim 1, wherein the first material comprises a gradient of reducing elasticity in a direction from luff to leech, as defined by its:

(i) failure strain, or (ii) average Young's Modulus, or (iii) both (i) and (ii).

17. The sail of claim 16, wherein the first material comprises polyester.

18. The sail of claim 16, wherein the first material comprises polyester in combination with one or more of aramid and UHMWPE.

19. The sail of claim 1, wherein a difference in elasticity is achieved by a lesser material thickness in the luff region compared with the remainder of the sail.

20. The sail of claim 1, wherein an orientation of a material in the luff region is different from an orientation of a material in the remainder of the sail, such that the luff region has a higher degree of elasticity compared to the remainder of the sail.

21. The sail of claim 1, wherein the luff region does not comprise any carbon fibres oriented within 15 degrees of parallel to the luff, and wherein the remainder of the sail does comprise carbon fibres oriented within 15 degrees of parallel to the luff.

22. The sail of claim 1, wherein the sail is a twin skin mainsail having two skins defining the sail, wherein each skin has a luff region extending along the luff, and wherein each luff region has a higher degree of elasticity compared to a remainder of the respective skin.

23. A sail comprising a head, a tack, a luff extending between the head and the tack; and a luff region extending along the luff;

wherein the luff region has a higher degree of elasticity compared to a remainder of the sail, wherein in a luff direction, a ratio of a stiffness of regions outside the luff region and the stiffness of the luff region is in a range of 2-25 times greater.

* * * * *